United States Patent [19]

Takahashi et al.

[11] Patent Number: 4,909,302

[45] Date of Patent: Mar. 20, 1990

[54] APPARATUS FOR ALIGNING POURING NOZZLE IN CONTINUOUS CASTING INSTALLATION

[75] Inventors: Shuzo Takahashi, Yokohama; Yutaka Tsuchida, Yokosuka; Shiro Osada, Yokohama; Hisashi Sato, Yokohama; Nobuhisa Hasebe, Yokohama; Masayuki Nakada, Yokohama, all of Japan

[73] Assignee: Ishikawajima-Harima Jukogyo Kabushiki Kaisha, Japan

[21] Appl. No.: 352,866

[22] Filed: May 17, 1989

[30] Foreign Application Priority Data

Jun. 10, 1988 [JP] Japan ..... 63-143332

[51] Int. Cl.[4] ..... B22D 11/06

[52] U.S. Cl. ..... 164/154; 164/430; 164/438

[58] Field of Search ..... 164/452, 453, 481, 488, 164/154, 430, 431, 432, 433, 434, 437, 438, 489, 483, 439

[56] References Cited

U.S. PATENT DOCUMENTS

| | | | |
|---|---|---|---|
| 3,921,697 | 11/1975 | Petry | 164/481 |
| 4,544,018 | 10/1985 | Figge et al. | 164/481 |
| 4,600,047 | 7/1986 | Matoba et al. | 164/453 |

FOREIGN PATENT DOCUMENTS

| | | |
|---|---|---|
| 60-234750 | 11/1985 | Japan . |
| 62-203645 | 9/1987 | Japan . |
| 63-119049 | 6/1988 | Japan . |

*Primary Examiner*—Richard K. Seidel
*Assistant Examiner*—Rex E. Pelto

[57] ABSTRACT

A dummy nozzle is used for alignment of a pouring nozzle upon insertion of the pouring nozzle in communication with a tundish into a mold cavity of an endless track type moving-block mold continuous casting machine.

1 Claim, 2 Drawing Sheets

APPARATUS FOR ALIGNING POURING NOZZLE IN CONTINUOUS CASTING INSTALLATION

BACKGROUND OF THE INVENTION

The present invention relates to an apparatus for aligning a pouring nozzle in a continuous casting installation which can automatically, easily and quickly align the nozzle.

Generally in a continuous casting installation with an endless-track type moving-block-mold continuous casting machine, a pouring nozzle secured to a tundish-mounting carriage is inserted, in operation, into a mold cavity of the casting machine. To this end, position adjustment means such as screw jacks joined to the tundish on the carriage are manually operated to adjust the position of the tundish, thereby aligning the pouring nozzle. Thereafter the carriage is advanced to insert the nozzle into the mold cavity.

In the installation, the gaps between the nozzle and the opposing block molds are to be very narrow in the order of 0.1–0.2 mm for prevention of the leakage of melt, so that the alignment of the nozzle must be accomplished accurately. Such accurate alignment operation takes a long period of time. When the accurate alignment is not made, the pouring nozzle may strike against the block mold, resulting in breakdown thereof upon insertion of the pouring nozzles into the mold cavity.

In view of the above, a primary object of the present invention is to accomplish the alignment of a nozzle automatically, easily and quickly in a continuous casting installation equipped with endless track type moving block molds.

The present invention will become more apparent from the following description of a preferred embodiment thereof taken in conjunction with the accompanying drawings.

DETAILED DESCRIPTION OF THE PREFERRED EMBODIMENT

Figure 1:
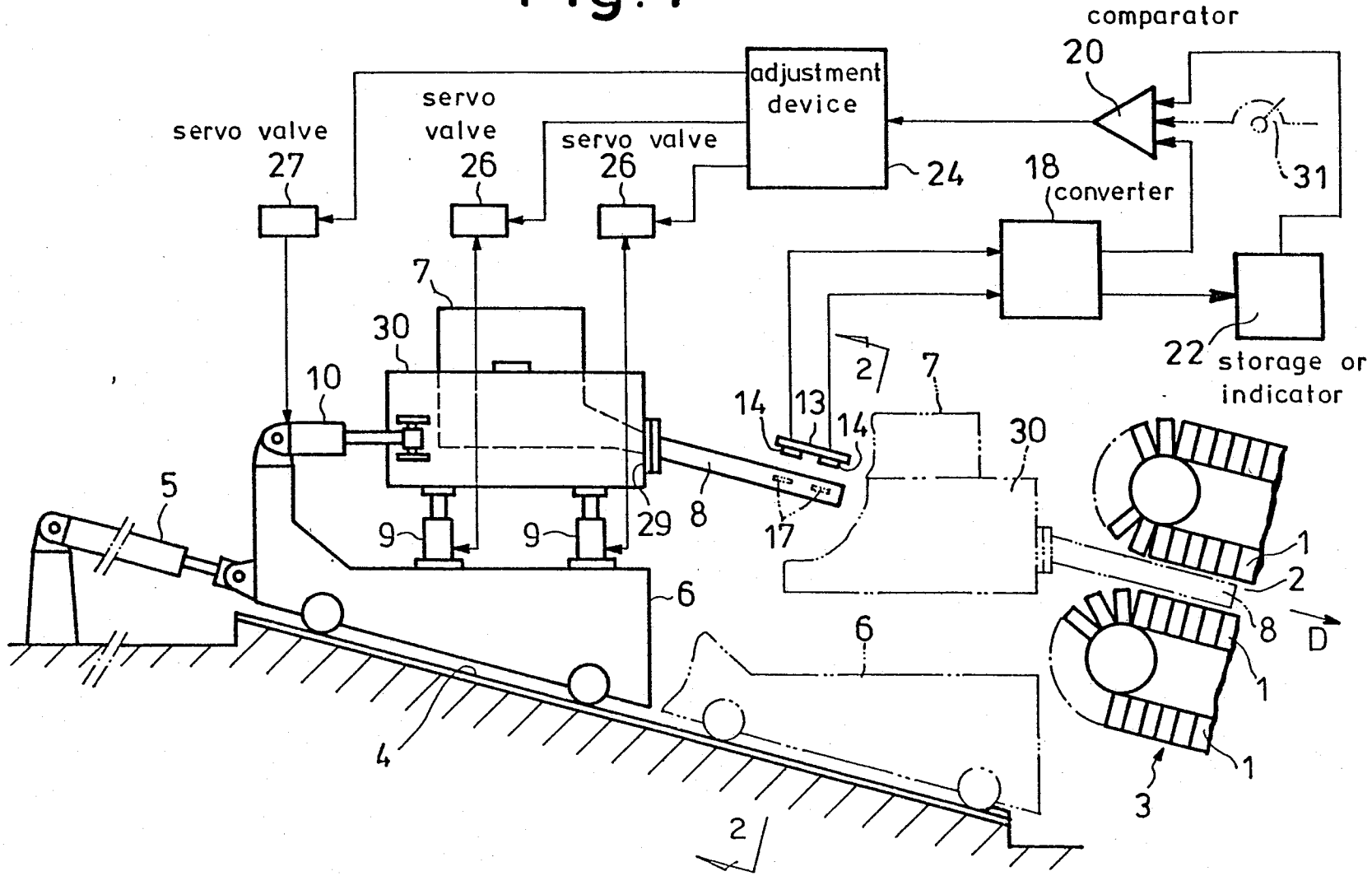
FIG. 1 is a side view of a preferred embodiment of the present invention.
Figure 2:
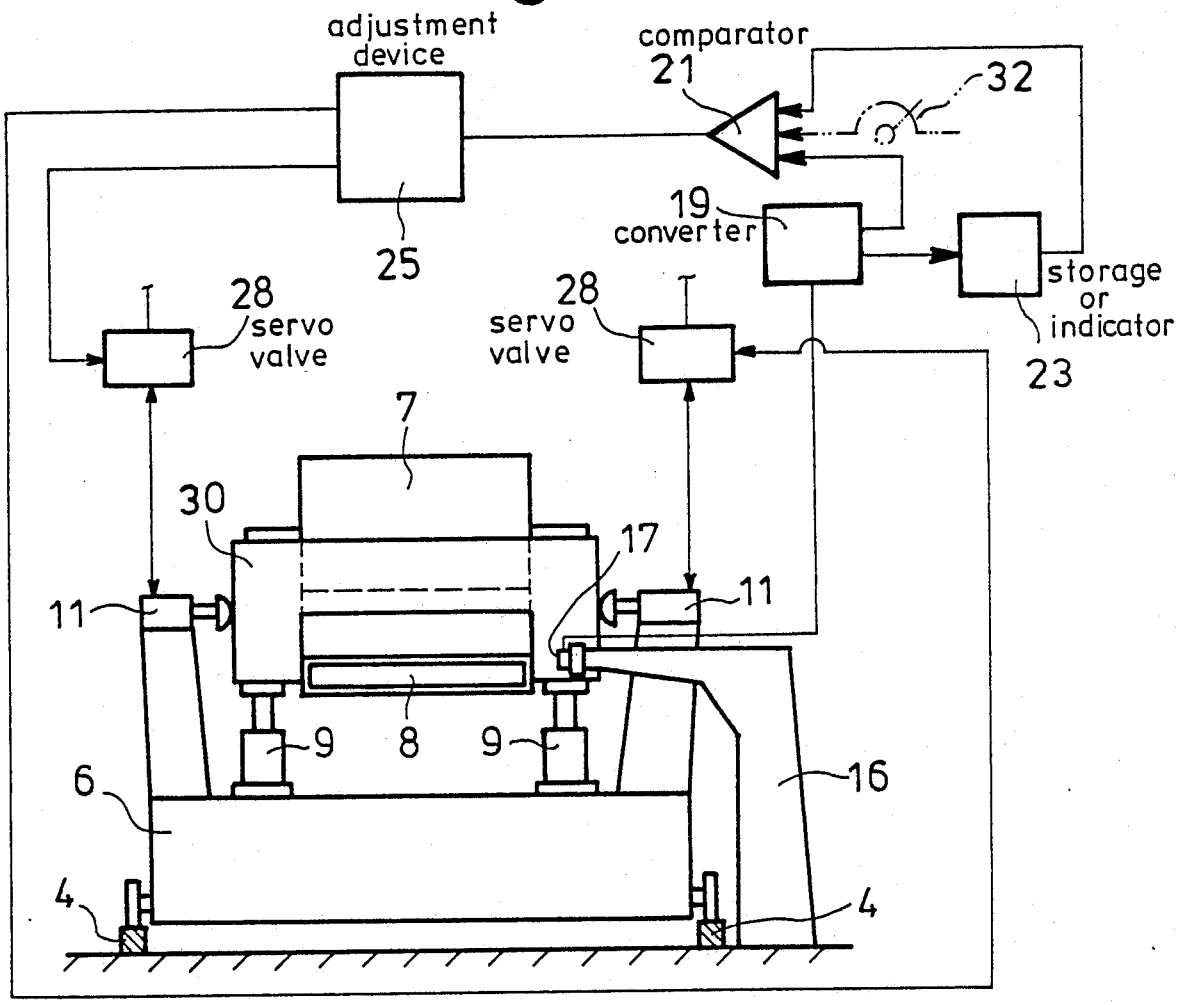
FIG. 2 is a view looking in the direction indicated by the arrows II in FIG. 1.
Figure 3:
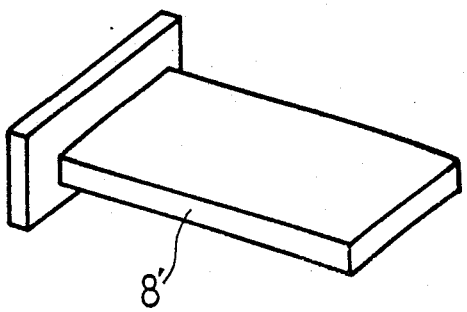
FIG. 3 is a perspective view of a dummy nozzle to be used in the invention.

Now referring to FIGS. 1–3, a preferred embodiment of the present invention will be described in detail.

An endless track type moving-block-mold continuous casting machine generally indicated by reference numeral 3 has a pair of upper and lower moving molds 1 which in turn have opposing surfaces moving in the same direction to define a mold cavity 2. The continuous casting machine 3 is disposed to be downwardly inclined from melt-pouring side in the direction D of withdrawal of a cast strand at an angle with respect to the horizontal. A pair of rails 4 are laid upstream of the continuous casting machine at the same angle of downward inclination as that of the machine 3 in the direction D. A carriage 6 ride on the rails 4 for movement toward and away from the continuous casting machine 3 by means of a hydraulic cylinder 5 in the direction in parallel with the cast-strand-withdrawing direction D.

A tundish-mounting stand 30 with a tundish 7 mounted thereon is vertically adjustably disposed on the carriage 6 through vertical hydraulic cylinders 9. A melt pouring nozzle 8 which is detachably mounted on the front surface of the stand 30 for communication with the tundish 7 extends toward the mold cavity 2 of the continuous casting machine 3. The tundish-mounting stand 30 is adapted to be position-adjusted with respect to and along the length of the carriage 6 by means of horizontal hydraulic cylinders 10 directed toward the continuous casting machine 3. The tundish-mounting stand 30 can be further position-adjusted with respect to and along the width of the carriage 6 by means of horizontal hydraulic cylinders 11 directed transversely of the direction D. For alignment operation, a dummy nozzle 8′ as best shown in FIG. 3 is adapted to be attached on the front surface of the tundish-mounting stand 30 in place of the pouring nozzle 8. The dummy nozzle 8′ is manufactured with a high degree of accurately to have the same size and shape as those of the pouring nozzle 8.

A frame 13 is disposed at upstream of an inlet of the mold cavity 2 of the casting machine 3 for its movement in the widthwise direction of the carriage 6. Two or more position sensors 14 such as eddy-current or potentiometric type position sensors are mounted on the frame 13 in opposed relationship with the nozzle 8 or 8′ so that the gaps or distances of the nozzle 8 or 8′ from the position sensors 14 can be detected.

Furthermore, an upwardly extending frame 16 is securely anchored to a foundation and is also disposed upstream of the continuous casting machine 3. Two or more position sensors 17 such as eddy-current or potentiometric type position sensors are mounted on the frame 16 alongside of the dummy nozzle 8′ so that the gaps or distances of the dummy nozzles 8′ from the position sensors 17 can be detected.

Output signals from the position sensors 14 and 17 are respectively delivered through converters 18 and 19 to comparators 20 and 21 and to storages or indicators 22 and 23, the comparators 20 and 21 being respectively connected to the storages or indicators 22 and 23. Outputs from the comparators 20 and 21 are respectively delivered through adjustment devices 24 and 25 to servo valves 26 and 27 and a servo valve 28 which in turn respectively control the flow rate or pressure of the liquid flowing into or out of the hydraulic cylinders 9 and 10 and a hydraulic cylinder 11.

Next the mode of operation of the present invention will be described.

The carriage 6 is moved to an uppermost limit position of the rails 4 by activating the hydraulic cylinder 5 and is stopped. After the dummy nozzle 8′ is attached to the front surface of the stand 30, the carriage 6 is moved downward by the cylinder 5 for insertion of the dummy nozzle 8′ into the mold cavity 2 of the continuous casting machine 3. The dummy nozzle 8′ is accurately aligned and centered by means of the servo valves 26, 27 and 28 such that the nozzle 8′ is centrally positioned between the upper and lower surfaces defining the mold cavity as well as between the side surfaces defining the same. Such accurate alignment may be carried out by an operator while he or she measures the distances of the dummy nozzle 8′ from the surfaces defining the mold cavity. Thereafter, the carriage 6 is moved again to the uppermost limit position of the rails 4 and is stopped. In that state, the gaps or distances of the dummy nozzles 8′ from the position sensors 14 and 17 are detected by the sensors 14 and 17 and signals representative of the detected gaps or distances are delivered to the storages or indicators 22 and 23.

Then, the dummy nozzle 8' is detached and the pouring nozzle 8 is attached to the carriage 30. Distances of the pouring nozzle 8 from the position sensors 14 and 17 are detected by the same. The signals representative of the sensed distances are delivered through the convertors 18 and 19 to the comparators 20 and 21 where the detected gaps are compared with the set gaps delivered from the storages or indicators 22 and 23 to obtain difference signals. The differences thus obtained are adjusted by the adjustment devices 24 and 25 into instruction signals in proportion to the differences and then delivered to the servo valves 26, 27 and 28 to control them. As a result, the liquids which flow into or out of the hydraulic cylinders 9, 10 and 11 are controlled by the servo valves 26, 27 and 28 so that the rods of the hydraulic cylinders 9, 10 and 11 are extended or retracted. As a result, the positions of the tundishmounting stand 30 in the vertical direction, the longitudinal direction and the widthwise direction can be adjusted, whereby the alignment of the pouring nozzle 8 is carried out. When the gaps of the pouring nozzle 8 detected become equal to those set with respect to the dummy nozzle 8', no difference signal is derived from the comparators 20 and 21 and the servo valves 26, 27 and 28 are closed. Thus the alignment operation of the pouring nozzle 8 is accomplished.

Thereafter, the frame 13 is moved out of the line and the hydraulic cylinder 5 is energized to move the carriage 6 along the rails 4 for insertion of the pouring nozzle 8 into the mold cavity 2 of the continuous casting machine 3. In the case where a nozzle replacement operation is carried out for, say, a damaged nozzle 8, the gaps or distances of a newly attached nozzle 8 from the position sensors 14 and 17 are detected by the latter. The detected gaps or distances of the new nozzle 8 are then adjusted in the manner described above so as to eliminate the differences from the predetected gaps of the dummy nozzle 8'.

According to the present invention, the pouring nozzle alignment operation is carried out automatically with no operators, quickly and correctly so that the shut-down time of the production line can be shortened; there is no fear of the pouring nozzle striking against the molds, which otherwise results in breakdown thereof; and safety in the operation is enhanced.

It is to be understood that the present invention is not limited to the preferred embodiment described above and that various modifications may be effected without leaving the true spirit of the present invention. It has been described that adjustment of the pouring nozzle 8 is effected on the basis of the signals from the storages or indicators 22 and 23 with respect to the dummy nozzle 8'; instead, the positions or gaps of the aligned dummy nozzle 8' are set by setting means 31 and 32 for adjustment operation of eliminating the difference between the set gaps and the detected gaps of the nozzle 8 detected by the sensors 14 and 17. The hydraulic cylinders used as actuators for adjusting the position of the nozzle may be substituted by screw jacks driven through worms and worm wheels. The present invention may be applied not only to an inclined continuous casting machine but also to a horizontal continuous casting machine.

According to the apparatus for aligning the pouring nozzle of the continuous casting installation of the present invention, the alignment of the pouring nozzle is carried out automatically with no operators, quickly and correctly so that the shut-down time of the production line can be shortened, resulting in the improvement of productivity. Furthermore, upon insertion of the pouring nozzle into the mold cavity, there is no fear of the pouring nozzle striking against the block molds, which otherwise results in breakdown thereof, so that safety in the operation can be enhanced.

What is claimed is:

1. In combination with an endless track type moving-block-mold continuous casting machine having a pair of upper and lower moving mold assemblies with opposing surfaces moved in the same direction to define a mold cavity, a tundish mounted through a tundish-mounting stand upon a carriage which can be moved to or away from an inlet of the mold cavity and a pouring nozzle adapted to be attached to the tundish-mounting stand for communication with the tundish and adapted to be inserted into said mold cavity, an apparatus for aligning the pouring nozzle comprising actuators for moving said tundish mounting stand on said carriage vertically, forwardly, backwardly and transversely, position sensor means for detecting the position of a dummy nozzle or the pouring nozzle with respect to said mold cavity, comparators for obtaining a difference between a position of the preliminary aligned dummy nozzle and a position of the pouring nozzle, and adjustment means responsive to outputs from said comparators for energizing said actuators, whereby contact of said pouring nozzle with the block mold assemblies can be prevented.

* * * * *

UNITED STATES PATENT AND TRADEMARK OFFICE

CERTIFICATE OF CORRECTION

PATENT NO. : 4,909,302

DATED : March 20, 1990

INVENTOR(S) : Shuzo Tahahashi, et al

It is certified that error appears in the above-identified patent and that said Letters Patent is hereby corrected as shown below:

Title page:

[73] Assignee: Ishikawajima-Harima Jukogyo Kabushiki Kaisha
and
Nippon Kokan Kabushiki Kaisha,
both of Japan

Signed and Sealed this

Twenty-eighth Day of May, 1991

*Attest:*

HARRY F. MANBECK, JR.

*Attesting Officer*

*Commissioner of Patents and Trademarks*